United States Patent [19]

Franz et al.

[11] Patent Number: 4,993,305

[45] Date of Patent: Feb. 19, 1991

[54] MANUAL WITH PIANO EFFECT FOR USE IN ELECTRONIC ORGANS

[75] Inventors: Reinhard Franz, Emmelshausen; Walfried Dost, Koblenz, both of Fed. Rep. of Germany

[73] Assignee: Wersi GmbH & Co., Halsenbach, Fed. Rep. of Germany

[21] Appl. No.: 484,866

[22] Filed: Feb. 23, 1990

[30] Foreign Application Priority Data

Feb. 24, 1989 [DE] Fed. Rep. of Germany ..... 3905646

[51] Int. Cl.[5] ..... G10D 3/12

[52] U.S. Cl. ..... 84/439

[58] Field of Search ..... 84/239, 247–249, 84/433, 439, 440, 467

[56] References Cited

U.S. PATENT DOCUMENTS 4,217,803 8/1980 Dodds ..... 84/439 X
4,860,630 8/1989 Franz ..... 84/439
4,901,614 2/1990 Kumano et al. ..... 84/433 X

FOREIGN PATENT DOCUMENTS 0270966 6/1988 European Pat. Off. .
2426016 7/1975 Fed. Rep. of Germany .
252696 12/1987 Fed. Rep. of Germany .
3601892 10/1988 Fed. Rep. of Germany .

*Primary Examiner*—Brian W. Brown
*Attorney, Agent, or Firm*—Peter K. Kontler

[57] ABSTRACT

The actions of a manual with piano effect for use in electronic organs have keys which are pivotable about a first horizontal axis and carry rigid or elastic pushers abutting plate-like motion receiving portions on the first arms of discrete reaction levers. The second arm of each lever carries a weight which urges the motion receiving portion of the first arm against a pad at the adjacent end of the pusher. The distance of the point of contact between the pusher and the first arm of the reaction lever from the respective key in idle posotion of the key is greater than the distance of the key from the pivot axis of the reaction lever. This renders it possible to ensure that the resistance of the reaction lever to further depression of the respective key decreases in response to pivoting of the key through a predetermined angle from its idle position. The pusher engages only the first arm of the respective reaction lever and is fixedly secured to the respective key.

26 Claims, 4 Drawing Sheets

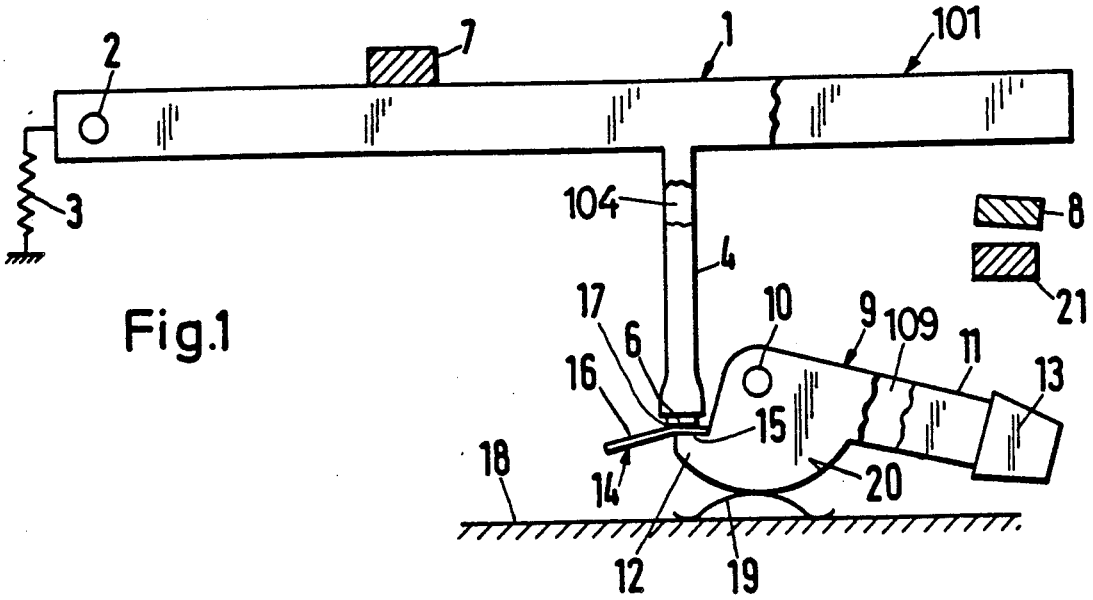
Fig.1
Fig.2
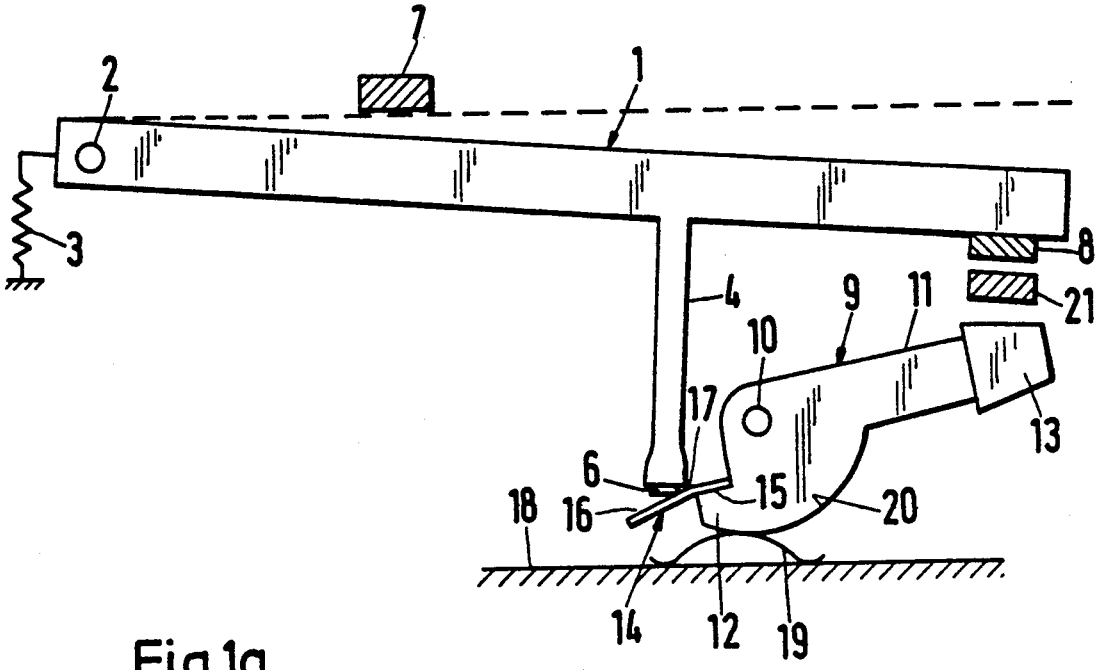
Fig.1a
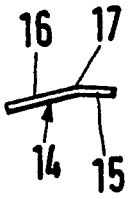
Fig.1b
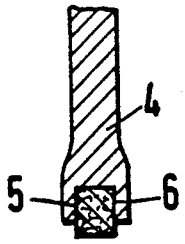

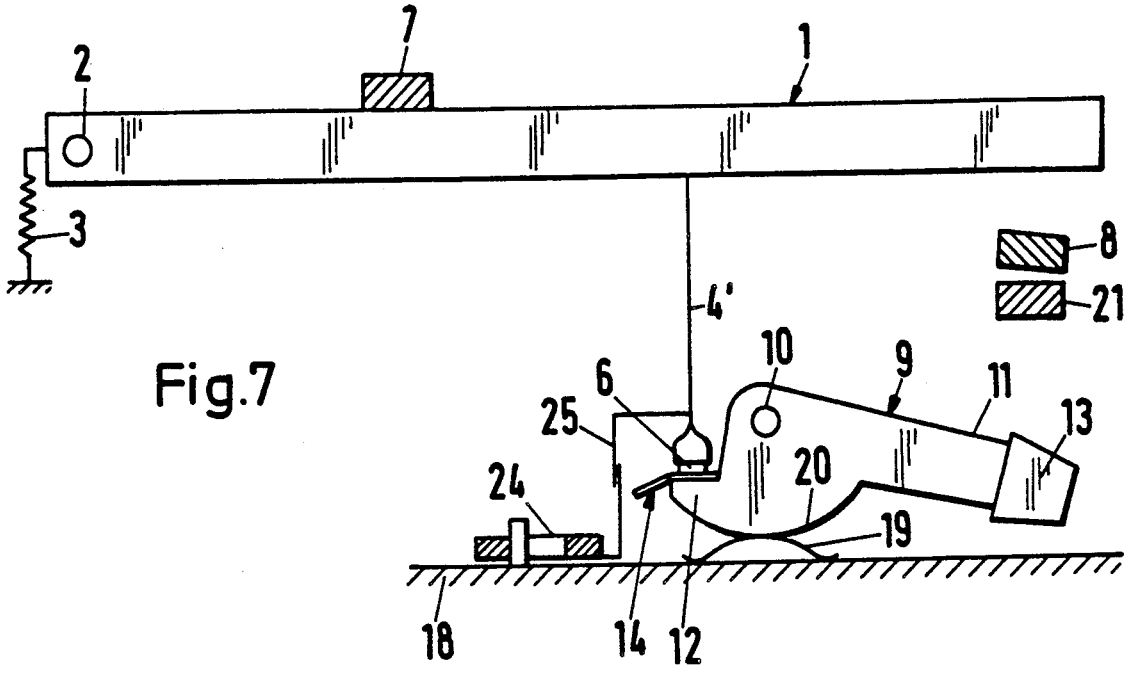
Fig.7
Fig.8
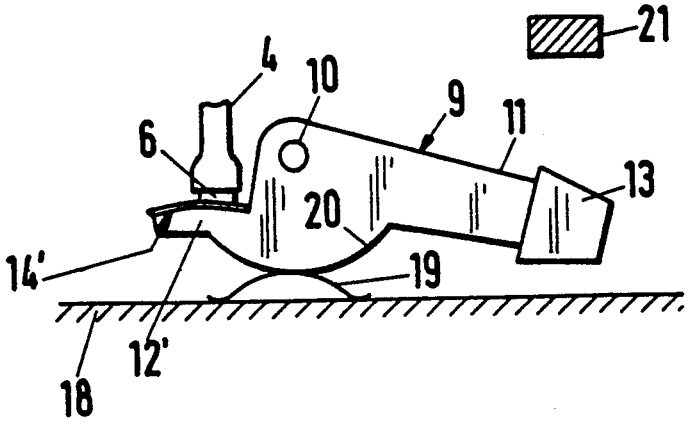
Fig.9
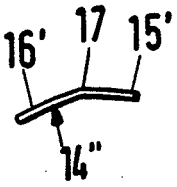

MANUAL WITH PIANO EFFECT FOR USE IN ELECTRONIC ORGANS

CROSS-REFERENCE TO RELATED INVENTION

The manual of the present invention constitutes an improvement over and a further development of the manual which is disclosed in commonly owned U.S. Pat. No. 4,860,630 granted Aug. 29, 1989 for "Manual for electronic organs and the like". The disclosure of the patent is incorporated herein by reference.

BACKGROUND OF THE INVENTION

The invention relates to manuals for use in electronic organs and analogous musical instruments. More particularly, the invention relates to improvements in manuals with piano effect wherein each key is pivotable from idle position about a normally horizontal axis against the resistance of a spring and carries a pusher which can pivot a reaction member so that the latter is caused to turn about a second normally horizontal axis. Still more particularly, the invention relates to improvements in manuals wherein the initial stage of depression of the key from its idle position encounters a greater resistance and the resistance thereupon decreases as the pusher of the key and the reaction member are caused to move relative to each other. As a rule, the greater resistance is offered by the mass and inertia of a weight which is carried by the reaction member, and the resistance decreases as a result of increasing distance of the locus of contact between the pusher and the reaction member from the pivot axis of the reaction member.

As used herein, the term "electronic organs" is intended to embrace so-called keyboards as well as electronic pianos.

Published European patent application No. 0,270,966 of Franz discloses a manual which can be used in an electronic organ and wherein the touch of the keys is intended to resemble that of the keys in a standard piano. This is proposed to be accomplished in that, during the initial stage of depression of a key, the full force or substantially the entire force which is applied to the depressible end portion of the key is transmitted to the reaction member by a pusher on the key, namely to a first arm of the reaction member which carries the weight, i.e., in the same way as in the action of a standard manual for use in mechanical pianos. The ratio of distance of the point of contact between the pusher and the reaction member from the pivot axis of the reaction member to the distance of the center of gravity of the weight-carrying first arm of the reaction member from the pivot axis of the reaction member is very small. This, combined with the aforementioned transmission of full force to the reaction member, entails a pronounced initial acceleration of the reaction member and results in the development of a large reaction force (product of mass and acceleration), just as in a standard piano. A second arm of the reaction member causes the pusher to pivot shortly after the start of depression of the key so that the direction of application of the force from the pusher to the reaction member is changed from a direction substantially at right angles to the motion receiving portion of the first arm of the reaction member (namely at right angles to a tangent to the convex pusher-contacting surface of the first arm) to a direction such that the pusher slides along the adjacent surface of the first arm. Therefore, only a certain component of the force which was previously transmitted by the pusher continues to be transmitted to the adjacent surface of the first arm of the reaction member. At the same time, the pusher moves away from the pivot axis of the reaction member and, therefore, the reaction force of the reaction member decreases very rapidly to simulate the effect which is customary in standard pianos and is familiar to a person normally or often playing a standard piano.

An advantage of the manual which is disclosed by Franz is that each action of the manual can employ a simple rod- or stud-shaped straight pusher without an additional lever arm which is necessary in connection with pusher tongues of standard piano actions and without the need for release elements which must be employed in standard actions. The second arm of the reaction member in the action of Franz carries out the function of the release element. A composite joint between the pusher and the key enables the second arm of the reaction member to change the orientation of the pusher relative to the adjacent surface of the reaction member upon completion of the first stage of pivoting of the key from its idle position. This second arm of the reaction member is provided with a cushion serving to reduce the noise which is likely to be generated during return movement of the pusher to its normal or initial position. A drawback of the cushion is that its initial cost and its mounting contribute to the overall cost of the action. Moreover, if the cushion is not readily deformable, its noise-suppressing action is likely to be unsatisfactory. On the other hand, a readily deformable cushion prevents predictable and reproducible selection of that stage of pivoting of the key from its idle position at which the resistance to further depression of the key decreases. The reason is that it is difficult to invariably ensure that the pusher will begin to slide with reference to the first arm of the reaction member in response to a predetermined angular displacement of the key from its idle position. Still further, a relatively thick and soft cushion is likely to alter (lose) its deformability with time so that the noise-suppressing action of such cushion becomes unsatisfactory after a relatively short period of use of the action.

U.S. Pat. No. 4,217,803 to Dodds discloses an action wherein the pusher is rigid with the key. Similar actions are disclosed in German Auslegeschrift No. 24 26 016 of Aliprandi and in German Pat. No. 36 01 892 to Franz. East German patent No. 252 696/ discloses a rigid pusher.

OBJECTS OF THE INVENTION

An object of the invention is to provide an action which is simpler and generates less noise than heretofore known actions.

Another object of the invention is to provide an action which invariably ensures that a reduction of resistance to depression of the key takes place in response to a predetermined angular displacement of the key from its idle position.

A further object of the invention is to provide a novel and improved pusher for use in the above outlined action.

An additional object of the invention is to provide a novel and improved reaction member for use in the above outlined action.

Still another object of the invention is to provide novel and improved means for predictably changing and selecting that angular position of the key in which the resistance to further depression of the key decreases.

A further object of the invention is to provide the action with novel and improved means for preventing stray movements of the reaction member relative to the key and/or relative to the pusher.

Another object of the invention is to provide an action wherein the extent to which the resistance to further depression of the key is reduced can be varied in a novel and improved way.

SUMMARY OF THE INVENTION

The invention resides in the provision of a manual with piano effect for use in electronic organs and analogous musical instruments. The improved manual comprises at least one action including a key which is pivotable about a preferably horizontal first axis between an idle position and a depressed position, and a reaction member pivotable about a preferably horizontal second axis which is preferably parallel to the first axis and is spaced apart from the key. The reaction member has an arm including a motion receiving portion, and each action of the manual further comprises a pusher which is fixedly secured to the key and has a motion transmitting end serving to contact only the motion receiving portion of the arm so as to pivot the reaction member from a first position to a second position in response to pivoting of the key from the idle position to the depressed position. The motion transmitting end of the pusher contacts the motion receiving portion of the arm at a first distance from the key and, when held in the idle position, the key is disposed at a lesser second distance from the second axis.

The reaction member comprises means (such as a second arm which carries one or more weights) for maintaining the motion receiving portion in uninterrupted contact with the motion transmitting end of the pusher.

The motion receiving portion can comprise two facets and a ridge which is disposed between the two facets and is or can be substantially parallel to the second axis. The motion transmitting end of the pusher contacts one of the facets in the idle position and the other facet in the depressed position of the key. At least one of the facets can be substantially flat or at least slightly curved, particularly convex. It is preferred that the two facets make a large obtuse angle which closer to 180° than to 90°. One of the facets is nearer to and the other of the facets is more distant from the second axis, and the motion transmitting end of the pusher engages the one facet when the key is caused or permitted to assume its idle position, i.e., the motion transmitting portion engages the other facet in depressed position of the key.

Alternatively, the motion receiving portion can be provided with a single substantially convex facet which is permanently contacted by the motion transmitting end of the pusher.

The manual can further comprise means for changing the positions of the pusher and the second axis relative to each other. The pusher is or can be elongated and has a longitudinal axis which is spaced apart from and is substantially normal to the second axis (and which can be normal to the first axis). The means for changing can include means for varying the distance of the second axis and the longitudinal axis from each other. If the manual comprises a plurality of actions with keys, associated pushers and reaction members, the means for changing the distance of the longitudinal axis of one of the pushers and the respective second axis relative to each other can be designed to simultaneously vary the distance of the longitudinal axes of two or more pushers from the respective second axes.

The pusher is or can be elastic. For example, the pusher can include or constitute a metallic leaf spring (e.g., a spring which is made of spring steel). The means for varying the distance of the longitudinal axis and the second axis relative to each other can comprise an eccentric which serves to flex the pusher relative to the second axis. Alternatively, the means for varying can comprise a reciprocable element (e.g., a slide) which serves to flex the pusher relative to the second axis.

The second axis is defined by a pivot member (e.g., a shaft), and each action of the manual further comprises a bearing for the respective pivot member. The aforementioned varying means can include means for moving the bearing between a plurality of positions to thereby change the position of the second axis relative to the pusher.

The arm of the reaction member can be provided with a platform, and the motion receiving portion of the reaction member can comprise an elastically deformable plate or panel having a first section which overlies and is affixed to the platform, and an unsupported second section. The motion transmitting end of the pusher can abut the one or the other section of the panel in the idle position of the key. At least one section of the panel can be disposed substantially radially of the second axis.

Alternatively, at least the major part or the entire panel can abut the platform.

Each action of the manual can further comprise vibration damping means for the reaction member. Such vibration damping means can comprise a friction generating device which engages the reaction member. The friction generating device can comprise a stressed stationary leaf spring which bears upon the reaction member. For example, one end of the leaf spring can be riveted or otherwise secured to a stationary support adjacent the reaction member. The spring can engage a convex surface of the reaction member; the center of curvature of such convex surface can be located at or on the second axis.

That surface of the motion receiving portion which is contacted by the motion transmitting end of the pusher can be smooth, and the adjacent surface of the motion transmitting end can be defined by a cushion or pad. To this end, the pusher can be provided with a socket which receives a portion of the cushion or pad.

The novel features which are considered as characteristic of the invention are set forth in particular in the appended claims. The improved manual itself, however, both as to its construction and the mode of operation of its actions, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a partly elevational and partly vertical sectional view of an action forming part of a manual which embodies one form of the invention, the key of the action being shown in the idle position;

FIG. 1*a* is an elevational view of the detachable motion receiving portion of the reaction member;

FIG. 1*b* is a somewhat enlarged fragmentary longitudinal sectional view of the pusher;

FIG. 2 illustrated the action of FIG. 1 but with the key in depressed position;

FIG. 7 is a partly elevational and partly vertical sectional view of a further action wherein the elastic pusher is deformable by a reciprocable distance-varying element;

FIG. 8 is a fragmentary elevational view of an additional action wherein the entire motion receiving portion abuts a platform of the reaction member; and FIG. 9 is an elevational view of a further motion receiving portion which can be used as a component of the reaction member.

DESCRIPTION OF PREFERRED EMBODIMENTS

Figure 3:
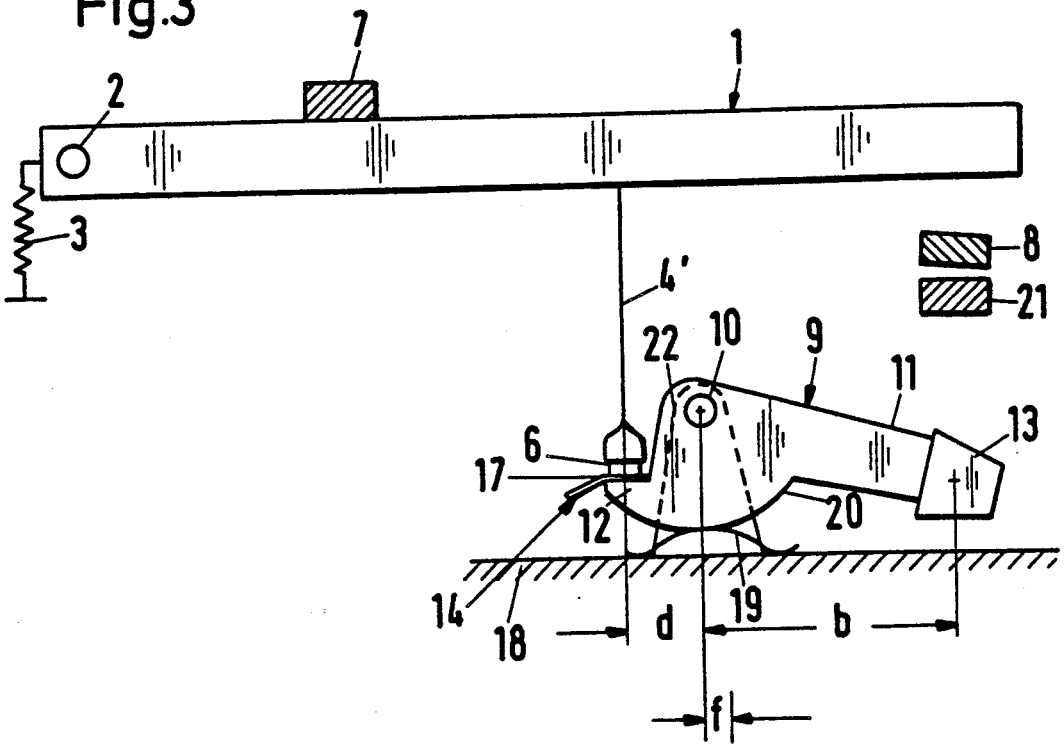
FIG. 3 is a partly elevational and partly vertical sectional view of a second action which employs an elastic pusher and wherein the pivot axis of the reaction member is movable relative to the longitudinal axis of the pusher, the key being shown in the idle position.

The improved manual comprises a number of actions each of which comprises a key, a pusher and a reaction member. FIGS. 1 and 2 show a first action comprising an elongated key 1 which is pivotable about a horizontal axis defined by a pivot member 2 and is permanently biased to the idle position of FIG. 1 by a coil spring 3. A median portion of the key 1 carries an elongated downwardly extending pusher 4 which, in the embodiment of FIGS. 1 and 2, is an integral part of the key and has a motion transmitting lower end including a socket 5 for a deformable cushion or pad 6 of felt or the like (see particularly FIG. 1*b*). The pusher 4 and the key 1 are located in a common vertical plane which further includes a reaction member 9 in the form of a two-armed lever pivotable about a horizontal axis defined by a second pivot member (e.g., a shaft) 10. The pivot member 10 is parallel to the pivot member 2 for the key 1, and the underside (lower surface) of the pad 6 forming part of the lower end of the pusher 4 is in permanent contact with the adjacent surface (upper side) of an elastic panel or plate 14 constituting the motion receiving portion of a short first arm 12 of the reaction member 9. The longer arm 11 of the member 9 carries a weight 13 and serves as a means for permanently biasing the upper side or surface of the motion receiving portion 14 (hereinafter called plate for short) against the pad 6. The longitudinal axis of the pusher 4 is or can be normal to the longitudinal axis of the key 1 and to the axes of the pivot members 2 and 10. It is also within the purview of the invention to rigidly connect (e.g., by screws or by adhesive or by welding) a separately produced pusher to the underside of the key 1.

The coil spring 3 normally maintains the key 1 in contact with a padded stop 7. The extent of movability (pivotability) of the key 1 from the idle position of FIG. 1 to the depressed position is determined by a second padded stop 8. FIG. 2 shows the key 1 in the fully depressed position.

The longer arm 11 of the reaction member 9 is located substantially diametrically opposite the shorter arm 12 which latter has a platform overlapped and contacted by a relatively short first section 15 (see also FIG. 1*a*) of the plate 14. The larger second section 16 is unsupported and its upper side or facet is contacted by the pad 6 in depressed position of the key 1. When the key 1 is held in the idle position of FIG. 1, the pad 6 contacts the upper side or facet of the section 15. The illustrated plate 14 is a separately produced elastic part (e.g., this plate can be made of spring steel) the section 15 of which is bonded to the platform of the shorter arm 12 of the reaction member 9. The facets of the sections 15, 16 are separated from each other by a more or less pronounced ridge 17 which is at least substantially parallel to the axis of the pivot member 10 for the reaction member 9. The pad 6 rides over the ridge 17 during pivoting of the key 1 from the idle position of FIG. 1 to the depressed position of FIG. 2 or vice versa.

The lever 9 can be made of a plastic material having a relatively low specific weight. On the other hand, the weight 13 at the free end of the arm 11 can be made of lead or another material having a much higher specific weight than the material of the arms 11 and 12. The pivot member 10 is located between the weight 13 and the pusher 4, i.e., the longer arm 11 of the reaction member 9 extends from the axis of the pivot member 10 in a direction away from the pusher 4 and the shorter arm 12 extends from the axis of the pivot member 10 toward the pusher 4.

The upper sides or facets of sections 15, 16 of the plate 14 make a large obtuse angle which is much closer to 180° than to 90°, and the larger section 16 extends substantially radially of and away from the axis of the pivot member 10 for the reaction member 9. That (median) portion of the plate 14 which includes the ridge 17 can be said to constitute a simple hinge which enables the section 16 to pivot relative to the section 15 about an axis extending in parallelism with the axes of the pivot members 2 and 10. The facets (upper sides) of the sections 15, 16 are preferably smooth, e.g., they can be polished to a high degree of finish.

When the key 1 is maintained in the idle position of FIG. 1, the underside of the deformable pad 6 abuts only or primarily the facet of the section 15. At such time, the distance of the underside of the key 1 from the facet of the section 15 is greater than the distance of the underside of the key from the axis of the pivot member 10. As can be seen in FIG. 1, the facet of the section 15 is substantially horizontal when the spring 3 is free to maintain the key 1 in abutment with the stop 7.

The manual comprises a frame or support 18 which carries a leaf spring 19 serving as a means for damping vibrations of the reaction member 9. The spring 19 can be said to constitute a friction generating device which is in permanent contact with a convex surface 20 of the reaction member 9. The center of curvature of the convex surface 20 is at or on the axis of the pivot member 10. One end of the leaf spring 19 is bolted, riveted or otherwise secured to the frame 18, and this spring is mounted in stressed condition so that it remains in uninterrupted contact with the convex surface 20 and thus opposes pivoting of the reaction member 9 about the axis of the pivot member 10. An important function of the spring 19 is to oppose vibratory and/or other stray movements of the reaction member 9 in the idle position and in the depressed position of the key 1.

When a player applies downward pressure against the free right-hand end of the key 1, the key is caused to pivot in a clockwise direction from the idle position of FIG. 1 toward the depressed position of FIG. 2. The underside of the pad 6 forming part of the motion transmitting lower end of the pusher 4 bears against the facet of the section 15 and causes the reaction member 9 to pivot in a counterclockwise direction from the first position of FIG. 1 toward the second position of FIG. 2. Such pivotal movement of the reaction member 9 takes place against the opposition of the weight 13, i.e., the finger which presses the free end of the key 1 must overcome the combined mass and inertia of the longer arm 11 and weight 13. The effective length of the arms 11 and 12 (i.e., the horizontal distance of the location of contact between the pad 6 and the facet of the section 15 and of the combined center of gravity of the arm 11 and weight 13 from the axis of the pivot member 10) also plays a role in determining the magnitude of force which must be applied in order to pivot the key 1 from the idle position of FIG. 1. The second position of the reaction member 9 is or can be determined by a padded stop 21 which is located in the path of movement of the weight 13 and is adjacent the padded stop 8.

The first or initial stage of pivotal movement of the key 1 and reaction member 9 from the positions of FIG. 1 to the positions of FIG. 2 encounters a rather pronounced resistance which is offered to a large extent by the mass and inertia of the weight 13 on the longer arm 11 of the reaction member. The resistance decreases rather abruptly when the underside of the pad 6 advances over the ridge 17 and engages the larger section 16 of the plate 14. The transition from the aforementioned initial stage of pivotal movement of the key 1 and pusher 4 in a clockwise direction (jointly with the movement of the reaction member 9 in a counterclockwise direction) is readily detectable by the finger of the player and takes place when the pad 6 abruptly slides over the ridge 17 and engages the section 16 of the plate 14. In other words, the finger of the player senses a detectable drop of resistance to further depression of the key 1, the same as in a standard piano action. The reduction of resistance to pivoting of the key 1 to the depressed position of FIG. 2 is even more pronounced as a result of pivoting of the section 16 relative to the section 15 of the plate 14 along the hinge which includes the ridge 17. In addition, the horizontal distance of the locus of contact between the plate 14 and the pad 6 from axis of the pivot member 10 increases in response to pivoting of the key 1 from the idle position of FIG. 1, and this also results in a reduction of resistance to further pivoting of the key 1 to the position of FIG. 2 because the ratio of effective lengths of the arms 11, 12 of the reaction member 9 changes due to an increase of distance of the locus of contact between the pad 6 and plate 14 from the axis of the pivot member 10. The effective length of the arm 11 (i.e., the distance of the combined center of gravity of the arm 11 and mass 13 from the axis of the pivot member 10) remains substantially unchanged irrespective of the angular position of the reaction member 9.

As already mentioned above, the distance of the underside of the key 1 from the locus of contact between the pad 6 and the plate 14 is greater than the distance of the underside of the key and the axis of the pivot member 10 when the key is maintained in the idle position of FIG. 1. In addition, the pusher 4 engages only the plate 14 irrespective of the angular position of the key 1 and/or reaction member 9. This entails that the horizontal distance of the plate 14 from the axis of the pivot member 10 rapidly decreases in response to depression of the key 1 with the result that the resistance to further depression of the key decreases as the key approaches the depressed position of FIG. 2. Such reduction of resistance to depression of the key 1 is further enhanced due to the fact that the relative velocity of the cushion 6 is added to the relative velocity of the plate 14 which contributes to a so-called "slip-through" effect and causes the player to readily detect or note the drop of resistance as the pad 6 slides over and beyond the ridge 17 in a direction from the upper side or facet of the section 15 toward the upper side or facet of the section 16 of the plate.14.

An advantage of the feature that the pad 6 contacts only the plate 14 is that depression of the key 1 does not initiate the generation of undesirable noise such as would develop if the pivoting of key 1 from the idle position were to entail a propulsion of the reaction member 9 away from contact with the pusher 4 so that the reaction member would strike against the pusher during or as a result of pivoting of the key back to the idle position. The weight 13 biases the plate 14 against the pad 6 during each stage of pivoting of the key 1 and reaction member 9 inclusive of the position of FIG. 1 in which the weight 13 tends to pivot the reaction member 9 in a clockwise direction to thus maintain the upper side (facet) of the section 15 in contact with the pad 6. As can be seen in FIGS. 1 and 2, the action does not comprise any means but the pusher 4 for arresting the reaction member 9 in its first position, i.e., nothing prevents the weight 13 from biasing the plate 14 against the pad 6. This contributes to simplicity of the action because the manual need not be provided with any means for compensating for play between the pusher and the reaction member in the idle position of the key.

The stressed leaf spring 19 cooperates with the convex surface 20 to reliably prevent stray movements of the reaction member 9 in the idle position as well as in the depressed position of the key 1. This is important when the key 1 held in depressed position for a certain interval of time, and it is equally important to prevent vibration of the reaction member in the idle position of the key.

An important advantage of the improved action is that only the pusher 4 engages the plate 14 and cooperates with the latter to pivot the reaction member 9 against the opposition of the mass and inertia of the parts 11 and 13. When the key 1 is depressed, the distance of the locus of contact between the pad 6 and the plate 14 from the axis of the pivot member 10 increases simultaneously with a movement of the platform for the plate 14 in a direction counter to the horizontal component of movement of the pad 6. In other words, the pad 6 moves to the left in response to depression of the key 1 because the pusher 4 is affixed to the key, and the horizontal component of movement of the plate 14 is to the right, i.e., counter to the direction of movement of the pad. It is assumed here that the pusher 4 is substantially vertical in the idle or undepressed position of the key 1. The above outlined combination of movements suffices to ensure that a relatively short movement of the pusher 4 about the axis of the pivot member 2 for the key 1 suffices to move the pad 6 over and beyond the ridge 17 of the plate 14, i.e., to reach a stage of pivotal movement of the key 1 when the resistance to further depression decreases. The pusher 4 is not entrained by (i.e., it need not follow the movement of) the shorter arm 12 of the reaction member 9. This renders it possible to dispense with an additional pad between the arm 12 and the pusher 4, and the exact stage of pivotal movement of the key 1 when the resistance to further depression of the key decreases can be selected in advance with a high degree of reproducibility. Furthermore, it is possible to dispense with a composite joint between the pusher and the key.

The aforediscussed feature that the pad 6 is in permanent contact with the plate 14 and that only the pusher 4 opposes further clockwise pivoting of the reaction member 9 in the idle position of the key 1 brings about the advantage that it is possible to dispense with an additional padded stop for the member 9, i.e., with a stop which would arrest the member 9 when the latter reaches the second position of FIG. 2. The pad 6 takes over the function of such stop in addition to its primary function of transmitting motion from the pusher 4 to the arm 12 in response to depression of the right-hand portion of the key 1. The likelihood that the arm 12 would bypass the pusher 4 or that the lower end of the pusher would bypass the arm 12 is avoided by the novel expedient of maintaining the pad 6 in uninterrupted contact with the plate 14. This ensures that the angular position of the reaction member 9 is always determined by the angular position of the key 1. In other words, the weight 13 cannot induce or initiate any movements of the arm 12 with reference to the pusher 4; on the contrary, the weight 13 performs the desirable function of permanently urging the plate 14 against the pad 6. The feature that the pad 6 is maintained in constant or uninterrupted abutment with the plate 14 ensures that the reaction member 9 cannot block pivoting of the key 1 between the idle and depressed positions as well as that the pusher 4 cannot interfere with intended or desirable pivotal movements of the reaction member. This, in turn, renders it possible to dispense with discrete means for compensating for clearance or play between the underside of the pad 6 and the facets of the sections 15, 16 of the plate 14 in the first end position of the reaction member 9. The reason is that the action does no comprise a discrete stop for termination of clockwise pivotal movement of the reaction member 9 beyond the end position of FIG. 1 so that the weight 13 on the arm 11 invariably maintains the plate 14 in contact with the pad 6, also in the idle position of the key 1.

The ridge 17 of the plate 14 constitutes a desirable but optional feature of the plate 14. As mentioned above, this ridge enables the player to readily sense the instant of transition from the stage when the key 1 encounters a greater resistance to depression and the stage when such resistance decreases for the above outlined reasons.

It is preferred to select the initial positions of the pad 6 and of the plate 14 relative to each other in such a way that the pad contacts only the facet of the section 15 when the spring 3 is free to maintain the key 1 in the idle position of FIG. 1. This ensures that the aforediscussed "slip-through" effect does not arise in immediate response to pivoting of the key 1 from the idle position of FIG. 1, i.e., the pad 6 initially slides along the facet of that section (15) which is nearer to the axis of the pivot member 10 and thereupon reaches and moves over the ridge 17 to thus produce the "slip-through" effect. Moreover, the sensation that the resistance to further depression of the key 1 has been reduced is not as pronounced as if the pad 6 were to slide over the ridge 17 during the initial stage of depression of the key. Nevertheless, it is possible to vary and select the exact timing of movement of the pad 6 over the ridge 17 following the start of pivotal movement of the key 1 from the idle position of FIG. 1. The means for effecting such adjustment are shown in FIGS. 3-4, 5-6 and 7. All that is necessary is to change the initial distance of the axis of the pivot member 10 from the longitudinal axis of the pusher 4.

The action of FIGS. 1 and 2 constitutes but one of a battery of actions which together constitute a complete manual. FIG. 1 shows a portion of a second key 101 behind the key 1, a portion of a second pusher 104 behind the pusher 4, and a portion of a second reaction member 109 behind the reaction member 9. The parts 101, 104, 109 of the second action cooperate in the same way as described in connection with the parts 1, 4, 9 of the fully illustrated action. The same holds true for the third, fourth, etc. actions of the manual.

Figure 4:
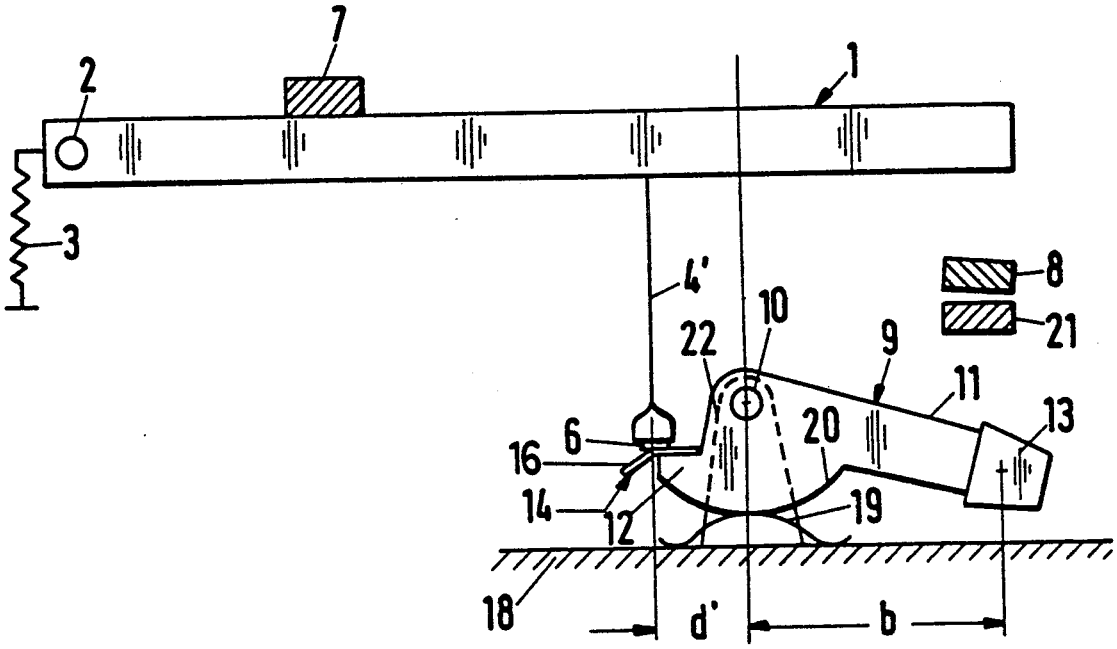
FIG. 4 illustrates the structure of FIG. 3 but with the pivot axis of the reaction member moved closer to the pusher.

The action of FIGS. 3 and 4 differs from the action of FIGS. 1 and 2 in that at least the major part of the pusher 4' is elastic. This pusher is an elongated leaf spring the lower end of which carries a head with a socket for the pad 6. The major part of the elastic pusher 4' can consist of spring steel sheet stock.

The bearing 22 for the pivot member 10 of FIGS. 3 and 4 is adjustable relative to the support 18 to vary the distance of the axis of the pivot member 10 from the longitudinal axis of the pusher 4'. The extent to which the illustrated bearing 22 is movable relative to the support 18 and pusher 4' is shown at f. Thus, the horizontal distance of the axis of the pusher 4' from the axis of the pivot member 10 for the reaction member 9 can be varied between the minimum distance d of FIG. 3 and the maximum distance d' (i.e., d+f) of FIG. 4. On the other hand, effective length b of the longer arm 11 of the reaction member 9 (i.e., the distance of the combined center of gravity of arm 11 and weight 13 from the axis of the pivot member 10) remains constant. The action of FIGS. 3 and 4 renders it possible to alter the transmission ratio of the reaction member 9, and hence the resistance of the key 1 to pivoting to the depressed position (not shown in FIGS. 3 and 4), while the musical instrument is in actual use. The resistance which the key 1 offers to depression is greater when the bearing 22 is held in the position of FIG. 3 and such resistance is reduced in response to movement of the bearing 22 toward or all the way to the position of FIG. 4.

The elastic pusher 4' is flexed during depression of the key 1 as soon as the pad 6 is caused to move over the ridge 17, and its flexing becomes more pronounced as the pad 6 slides along the section 16 of the plate 14. Flexing of the pusher 4' involves a movement of the pad 6 away from the axis of the pivot member 10. Thus, the elasticity of the pusher 4' is superimposed upon the elasticity of the section 16 of the plate 14 which contributes to a very pronounced "slip-through" effect as soon as the pad 6 moves over the ridge 17.

The means for moving the bearing 22 and the pivot member 10 toward or away from the pusher 4' is preferably designed to simultaneously move the bearings of all other actions which, with the action of FIGS. 3 and 4, together constitute a complete manual. As explained above with reference to FIGS. 1 and 2, the illustrated action is one of several actions which include keys 101, pushers 104 and reaction members 109 cooperating in the same way as described in connection with the parts 1, 4, 9 of FIGS. 1–2 or in connection with the parts 1, 4' 9 of FIGS. 3–4. The provision of common moving means for the bearings 22 of all actions in a manual contributes to simplicity of the musical instrument and ensures that the resistance which any one of the keys 1 or 101 offers to depression is the same as the resistance of each other key.

An advantage of the flexible elastic pusher 4' is that it is flexed at the time the pad 6 rides over the ridge 17 to thus contribute to a further pronounced reduction of resistance to depression of the key 1 from the idle position of FIG. 1 or FIGS. 3–4.

The action of FIGS. 3–4 with a flexible elastic pusher 4' exhibits the advantage that the difference between the initial resistance of the key 1 to depression from the illustrated idle position decreases even more as soon as the pad 6 reaches and advances beyond the ridge 17. The reason is that the pad 6 then engages the facet of the unsupported section 16 and the pusher 4' is flexed to move the pad 6 to the left (away from the axis of the pivot member 10) simultaneously with pivoting of the section 16 about the hinge which includes the ridge 17. Thus, the elasticity of the pusher 4' is superimposed upon the elasticity of the section 16.

If the key 1 is pivoted all the way to the depressed position of FIG. 2, the reaction member 9 can still have some freedom of further pivotal movement in a counterclockwise direction (FIG. 2 shows that the weight 13 is spaced apart from the stop 21 even though the right-hand end portion of the key 1 already abuts the stop 8). However, any such pivoting of the reaction member 9 all the way into abutment with the stop 21 is only short-lasting because the weight 13 immediately pivots the reaction member clockwise to return the plate 14 into contact with the pad 6. If the reaction member 9 is free to pivot away from contact with the pad 6 in fully depressed position of the key 1, the extent of such pivotal movement is small so that the plate 14 cannot strike against the pad 6 with a substantial force. In addition, at least the last stage of clockwise pivotal movement of the reaction member 9 toward renewed engagement with the pusher 4 or 4' is cushioned by the pad 6, and each stage of angular movement of the reaction member 9 is opposed by the stressed leaf spring 19 which contacts the convex surface 20 of the reaction member.

Furthermore, the just discussed feature ensures that the reaction member 9 can be maintained in a position which permits rapid repetition in a manner analogous to that of the hammer in a mechanical piano action when the hammer is to be maintained close to the respective string.

The spring 19 cooperates with the convex surface 20 to ensure that the resistance which the spring offers to stray movements of the reaction member 9 is the same in each angular position of the reaction member. This is due to the fact that the center of curvature of the surface 20 is located at or close to the axis of the pivot member 10.

Figure 5:
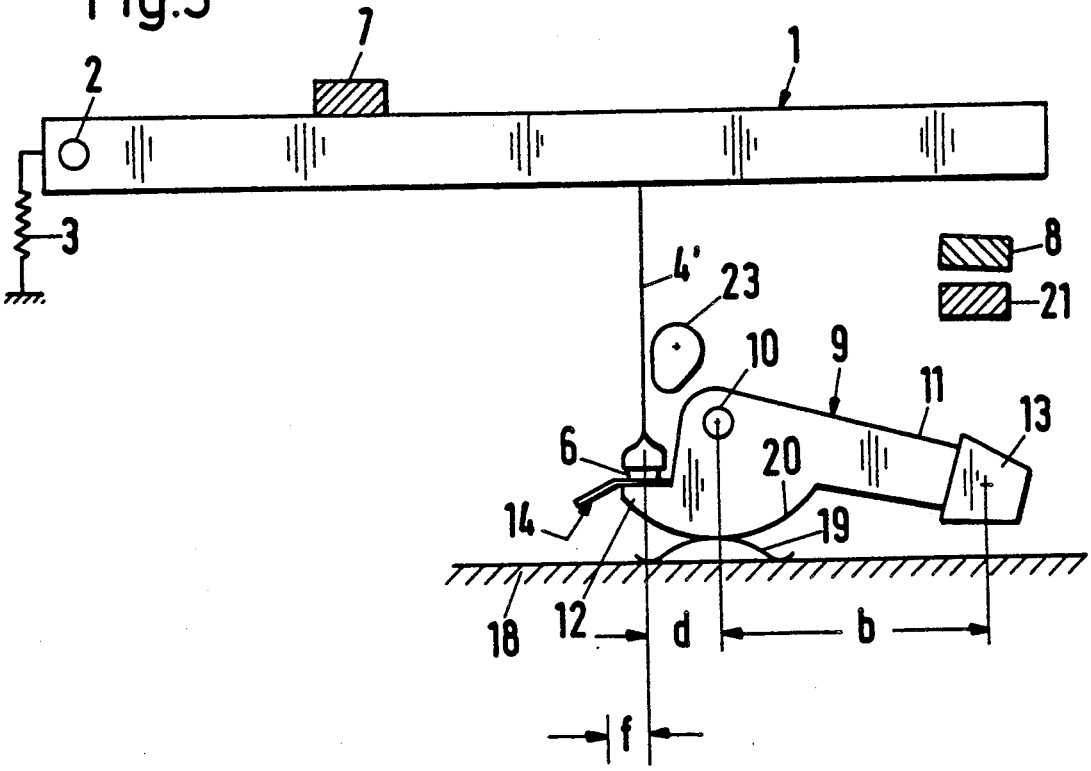
FIG. 5 is a partly elevational and partly vertical sectional view of a third action wherein the elastic pusher can be moved relative to the pivot axis of the reaction member by an eccentric which is shown in the inoperative position.
Figure 6:
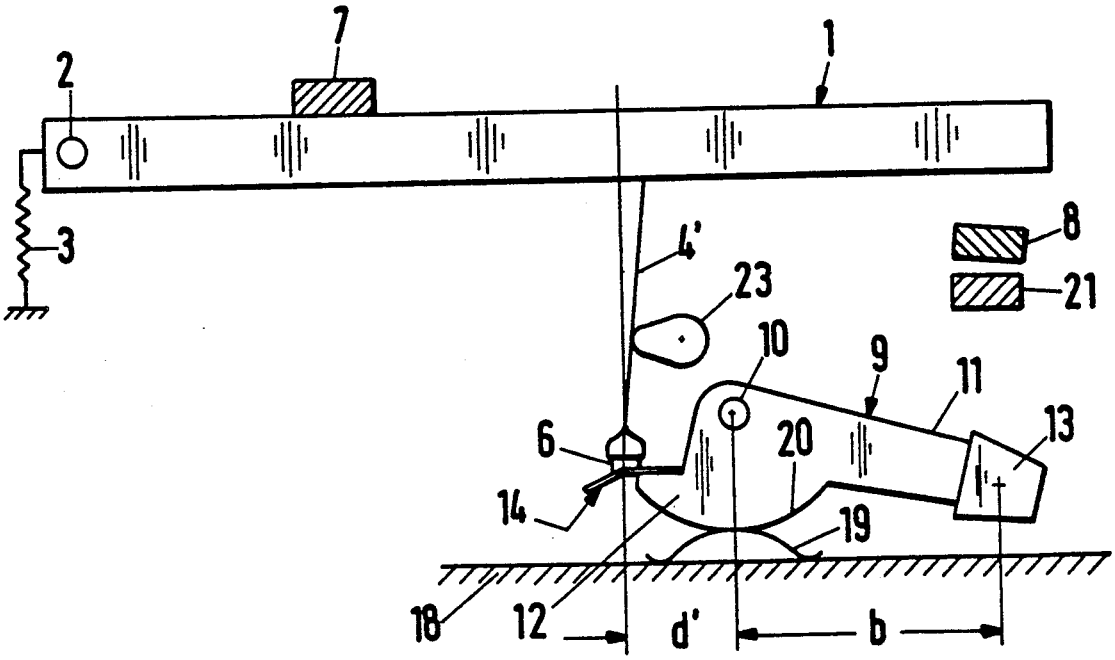
FIG. 6 illustrates the structure of FIG. 5 but with the eccentric in operative position in which the motion transmitting end of the elastic pusher is maintained at a greater distance from the pivot axis of the reaction member.

FIGS. 5 and 6 show a modification of the action of FIGS. 3 and 4. The bearing (not shown) for the pivot member 10 need not be moved relative to the support 18. Instead, the means for changing the distance of the axis of the elastic pusher 4' from the axis of the pivot member 10 comprises an eccentric 23 which is turnably mounted in or on the frame 18 and can engage an intermediate portion of the pusher to move the pad 6 from the position of FIG. 5 toward or all the way to the position of FIG. 6, i.e., to increase the distance of the locus of contact between the pad 6 and the plate 14 from d (FIG. 5) by f to d'. It is clear that the bearing 22 of FIGS. 3–4 and/or the eccentric 23 can be moved to and held in any desired number of intermediate positions, i.e., the distance d can be increased by f or by a desired fraction of f.

FIG. 7 shows a modification of the action of FIGS. 5 and 6. The means for changing the distance of the axis of the flexible pusher 4' from the axis of the pivot member 10 comprises a reciprocable element 24 which is movably mounted on the support 18 and has an extension engaging a hook-shaped follower 25 on a median portion of the pusher 4'. The slot of the reciprocable element 24 for a guide pin of the support 18 determines the extent of movability of the pad 6 from the normal position of FIG. 7 to an end position to the left of the illustrated position. The follower 25 can be omitted if the extension of the reciprocable element 24 is directly coupled to the elastic pusher 4'.

The element 24 can be arrested in any one of a desired number of intermediate positions, the same as the eccentric 23 of FIGS. 5–6 and the bearing 22 of FIGS. 3–4.

The means (not shown) for pivoting the eccentric 23 can be used to simultaneously pivot the eccentrics of other actions in the manual which embodies the action of FIGS. 5–6, and the reciprocable member 24 can serve to simultaneously flex the pushers 4' of all actions in a complete manual. This reduces the cost of the manual and ensures that the adjustment of any selected action matches the adjustment of each other action.

FIG. 8 shows a portion of an action wherein the platform of the shorter arm 12' of the reaction member 9 is sufficiently large to support the underside of the entire plate 14' or at least of the major part of the plate 14'. Moreover, the plate 14' is not provided with a pronounced ridge; instead, the entire upper surface of the plate 14' is convex all the way from the locus at a minimum distance from the axis of the pivot member 10 to the locus at a maximum distance from such axis. An advantage of the plate 14' is that the aforediscussed "slip-through" effect is very smooth, i.e., the transition of the pad 6 from engagement with the plate portion close to the pivot member 10 (as shown in FIG. 8) to engagement with that portion of the plate 14' which is remote from the pivot member 10 is gradual. The plate 14' need not be elastic because at least the major part of its underside abuts and adheres or is otherwise affixed to the platform of the arm 12'.

The action of FIG. 8 can also comprise means for varying the distance of the axis of the pusher 4 from the axis of the pivot member 10. The exact nature of such distance varying means will depend on the selected form of the pusher. Thus, if the pusher is rigid, the maker of the action will be likely to select an adjustable bearing 22. On the other hand, if the pusher is at least slightly elastic, the maker of the action can resort to the eccentric 23 of FIGS. 5–6 or to the reciprocable element 24 of FIG. 7.

FIG. 9 shows a modified plate 14" which can be used in lieu of the plate 14 or 14'. The upper sides (facets) of the sections 15', 16' of the plate 14" are slightly convex, and the plate is further provided with a rather pronounced ridge 17 which is disposed between the sections 15', 16' and is parallel or substantially parallel to the axis of the pivot member 10 when the plate 14" is properly affixed to the platform of the arm 12 or 12'.

The improved action can be modified in a number of additional ways. For example, the motion transmitting lower end of the pusher 4 or 4' need not be provided with a socket (5) for the pad 6. Instead, a flat pad 6 can be simply bonded (e.g., by means of an adhesive) to a flat underside of the main portion of the pusher 4 or 4'. Alternatively, the pusher 4 or 4' can be provided with a smooth and flat underside and the upper side of the plate 14, 14' or 14" can carry a thin pad of felt or the like. In other words, the pad can be affixed to the pusher 4 or 4' or to the plate 14, 14' or 14". The upper side of the plate 14, 14' or 14" can be provided with a socket in the form of a shallow depression which receives a portion of a pad. The just mentioned pad can be held in the depression by friction and/or by a suitable adhesive.

It is further within the purview of the invention to mount the reaction member 9 at a level above the respective key 1. Reference may be had to U.S. Pat. No. 4,860,630. Thus, the short left-hand arm of the key 1 can be extended at least slightly to the left beyond the pivot member 2, and the pusher 4 or 4' then extends upwardly from such extended left-hand arm to cooperate with the adjacent reaction member. All that is necessary is to modify the reaction member in such a way that its shorter arm 12 or 12' and its longer arm 11 extend from the same side of the axis of the pivot member for such reaction member, namely from the pivot axis of the reaction member toward the depressible right-hand end of the key 1. This would merely amount to a kinematic reversal of the operation of the illustrated key 1 and reaction member 9.

It is possible to omit the pad 6 (or a corresponding pad on the plate 14, 14' or 14") so that a smooth surface of the key 4 or 4' abuts a smooth surface or facet of the plate 14, 14' or 14". It is presently preferred to provide a pad on the motion transmitting end of the pusher 4 or 4' or on the plate 14, 14' or 14" because the pad acts not unlike a shock absorber and reduces the likelihood of noise generation in any angular position of the key and/or reaction member. In addition, friction between the pad and a smooth polished surface or facet on the pusher or plate is not very pronounced so that such friction contributes little or nothing to the resistance which must be overcome in order to pivot a key 1 or 101 to depressed position. The useful life of the pad 6 or of its equivalent on the plate 14, 14' or 14" is long because this pad is in contact with a smooth precision-finished surface. Recessing of a portion of the pad 6 or of the pad on the plate 14, 14' or 14" into a socket ensures that the pad is reliably held in the optimum position, especially if the pad is bonded to the adjacent part.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A manual with piano effect for use in musical instruments, comprising an action including a key pivotable about a first axis between an idle position and a depressed position; a reaction member pivotable about a second axis which is spaced apart from said key, said member having an arm including a motion receiving portion; and a pusher fixedly secured to said key and having a motion transmitting end arranged to contact only said motion receiving portion so as to pivot said member from a first to a second position in response to pivoting of said key from said idle position to said depressed position, said end of said pusher contacting said portion of said arm at a first distance from said key and said key being disposed at a lesser second distance from said second axis in the idle position thereof.

2. The manual of claim 1, wherein said reaction member has means for maintaining said motion receiving portion in substantially uninterrupted contact with said motion transmitting end of said pusher.

3. The manual of claim 1, wherein said motion receiving portion has two facets and a ridge disposed between said facets and being substantially parallel to said second axis, said motion transmitting end contacting one of said facets in the idle position and the other of said facets in the depressed position of said key.

4. The manual of claim 3, wherein at least one of said facets is substantially flat.

5. The manual of claim 3, wherein at least one of said facets is convex.

6. The manual of claim 3, wherein said facets make a large obtuse angle.

7. The manual of claim 3, wherein one of said facets is nearer to and the other of said facets is more distant from said second axis.

8. The manual of claim 7, wherein said motion transmitting end contacts said more distant facet in the depressed position of said key.

9. The manual of claim 1, wherein said motion receiving portion has a single substantially convex facet which is contacted by the end of said pusher.

10. The manual of claim 1, further comprising means for changing the positions of said pusher and said second axis relative to each other.

11. The manual of claim 10, wherein said pusher has a longitudinal axis which is spaced apart from and is substantially normal to said second axis, said means for changing including means for varying the distance of said second axis and said longitudinal axis from each other.

12. The manual of claim 11, further comprising a second key, a second pusher fixedly secured to said second key and a second reaction member pivotable by said second pusher, said means for changing including means for simultaneously varying the distance of the second axes from the respective longitudinal axes.

13. The manual of claim 11, wherein said pusher is elastic and said means for varying comprises an eccentric arranged to flex said pusher relative to said second axis.

14. The manual of claim 11, wherein said pusher is elastic and said means for varying comprises a reciprocable element arranged to flex said elastic pusher relative to said second axis.

15. The manual of claim 1, wherein said pusher is elastic.

16. The manual of claim 13, wherein said pusher includes a metallic leaf spring.

17. The manual of claim 1, further comprising a shaft which defines said second axis, a bearing for said shaft, and means for moving said bearing between a plurality of positions to thereby change the position of said second axis relative to said pusher.

18. The manual of claim 1, wherein said arm further comprises a platform and said motion receiving portion includes an elastically deformable panel having a first section overlying said platform and an unsupported second section, said motion transmitting end engaging said first section in the idle position of said key.

19. The manual of claim 18, wherein at least one of said sections is disposed substantially radially of said second axis.

20. The manual of claim 1, wherein said arm further comprises a platform and at least the major part of said motion receiving portion abuts said platform.

21. The manual of claim 1, further comprising vibration damping means for said reaction member.

22. The manual of claim 21, wherein said vibration damping means comprises a friction generating device which engages said reaction member.

23. The manual of claim 22, wherein said friction generating device includes a stressed leaf spring which bears upon said reaction member.

24. The manual of claim 22, wherein said reaction member comprises a surface having a center of curvature at or on said second axis, said friction generating device engaging said surface of said reaction member.

25. The manual of claim 1, wherein said motion receiving portion has a first surface and said motion transmitting end has a second surface abutting said first surface, one of said surfaces being smooth and the other of said surfaces being defined by a cushion.

26. The manual of claim 25, wherein said motion transmitting end has a socket and said cushion has a portion in said socket.

* * * * *